United States Patent [19]

Saito et al.

[11] 3,930,361

[45] Jan. 6, 1976

[54] SLIP WHEEL STRUCTURE OF A WATCH MOVEMENT

[75] Inventors: Mituo Saito, Tokyo; Goro Ishikawa, Higashiyamato; Hidetaka Tutiya, Akishima, all of Japan

[73] Assignee: Citizen Watch Co., Ltd., Tokyo, Japan

[22] Filed: Oct. 15, 1974

[21] Appl. No.: 515,068

[30] Foreign Application Priority Data

Oct. 16, 1973 Japan ..... 48-120200[U]
Mar. 4, 1974 Japan ..... 49-25374[U]

[52] U.S. Cl. ..... 58/85.5; 58/138; 58/139
[51] Int. Cl.[2] ..... G04B 27/00; G04B 13/02
[58] Field of Search ..... 58/138, 139, 59, 85.5

[56] References Cited

FOREIGN PATENTS OR APPLICATIONS 723,364 4/1932 France ..... 58/138

*Primary Examiner*—George H. Miller, Jr.
*Attorney, Agent, or Firm*—Holman & Stern

[57] ABSTRACT

A slip wheel arrangement of a watch movement in which a center wheel is provided with an integral arbor which, in turn is formed with a double-tapered portion. For a slip-on coupling of a cannon pinion with the arbor, the pinion is formed with an integral tubular portion which includes a middle resilient part and a thickened end part, and is provided with at least one inwardly projecting projection on the resilient part. The leading portion of the bore of the tubular portion has a diameter larger than the sum of a largest diameter measured at the forward part of the arbor from the double-tapered part, plus the coupling idle gap measured thereat, with the inward projection being positioned within the area of the leading portion.

2 Claims, 11 Drawing Figures

SLIP WHEEL STRUCTURE OF A WATCH MOVEMENT

BACKGROUND OF THE INVENTION

The present invention relates to a time piece mechanism and more specifically, to improvements in and relating to a slip clutch mechanism of the time piece.

DESCRIPTION OF THE PRIOR ART

A representative conventional structure of the slip wheel arrangement used in a watch movement is such that a cannon wheel is slipped on the arbor portion of a center wheel. In this arrangement, at least a projection is formed on the tubular portion of the cannon wheel for the purpose of establishing a friction engagement with a tapered portion formed on the arbor portion of the center wheel so as to frictionally transmit motion from the latter to the cannon wheel, as an example.

It is requisitely necessary to maintain the friction torque acting between the tapered portion and projection as far as possible among a large number of mass-produced watch movements, so as to quarantee the regular and accurate turning movement of the watch hands during the time-setting operation and with a reasonable manual effort exerted therefor.

A further requirement for the watch movement is to limit the axial thrust force to a reasonable range which force is required when a slip-on assembly of the cannon wheel with the center wheel is being carried out and even when observed among a large number of mass-produced watch movements. When an excess axial thrust is required during the assembly job, the position of bearing stones for the center wheel may be forcibly altered, resulting in a disadvantageous fluctuation in the longitudinal position of the latter and in inaccuracy of the time displaying operation of the watch hands. In addition, the cannon wheel may be subjected to excess deformation.

OBJECTS AND SUMMARY OF THE INVENTION

An object of the present invention is to provide an improved slip wheel structure devoid of the aforementioned conventional drawbacks.

A further object is to provide an improved slip wheel arrangement with which the axial slip-on effort can be effectively rationalized and the friction torque can be substantially stabilized.

These and further objects, features and advantages of the invention will become more apparent when read in connection with the following detailed description of the invention with reference to the accompanying drawings illustrative of several preferred embodiments of the invention, in comparison with the comparative prior art.

DETAILED DESCRIPTION OF THE ILLUSTRATED EMBODIMENTS

Referring now to the accompanying drawings, several preferred embodiments of the invention will be described in detail.

Figure 1:
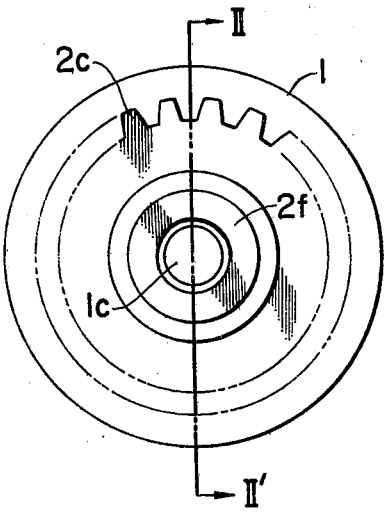
FIG. 1 is a front view of a first embodiment of the invention.
Figure 2:
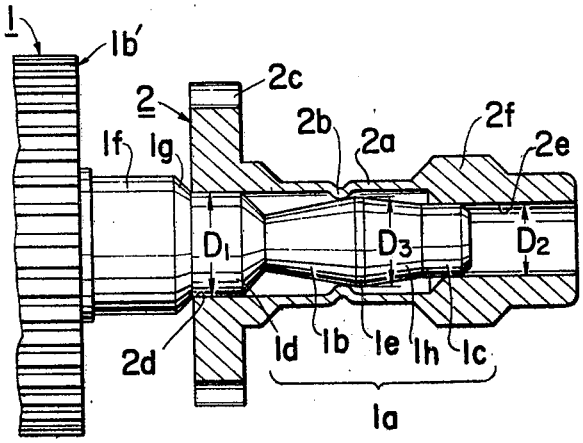
FIG. 2 is a longitudinal section thereof, substantially taken along a section line II — II′ shown in FIG. 1, FIGS. 3 and 4 are schematic sectional representations for the illustration of a conventional defective arrangement.

In FIGS. 1 and 2 showing a first embodiment of the invention, numeral 1 represents a center wheel and 2 a cannon wheel or pinion of a watch movement. In FIG. 1, however, the center wheel 1 is shown only by a single full-lined outline circle for simplicity and in FIG. 2, it is shown only partially.

The center wheel 1 comprises an arbor portion 1*a*; 1*g*; 1*f* and a gear portion 1*b*′ made integral with each other as shown. The cannon pinion 2 comprises a pinion portion 2*c* and a multistepped tubular portion 2*a* having a squeezed and inwardly projecting portion 2*b* at an intermediate position of the whole length of the latter. A stepped axial bore 2*d* is formed through the cannon pinion 2.

The center wheel 1 and the cannon pinion 2 are coupled with each other by a slip-on combination, as shown in FIG. 2.

The exposed root portion of arbor portion of the center wheel 1 comprises the cylindrical maximum diameter portion 1f and a tapered portion 1*g*, while the next succeeding cylindrical and intermediate diameter portion 1*d* is kept in a pressure fit with the starting beginning end of with axial bore 2*d*, with the portion 1d having a diameter D1 as shown. The starting bore end is formed concentrically with the pinion portion 2c.

The cylindrical and reduced diameter tip end portion 1*c* of the center wheel, having a smallest effective diameter D2 is kept in pressure engagement of the most reduced diameter portion 2*e* of the bore 2*d* around which the material of the tubular portion is thickened at 2*f*. The intermediate portion 2*a* of the tubular portion including said inward projection 2*b* and defined by and between the pinion portion 2*c* and thickened portion 2*f*, has the tube wall substantially reduced, so as to provide enough resiliency for the purpose to be later described.

The center wheel arbor represents a double tapered portion 1*b* – 1*e* – 1*h* of which the middle portion 1*e* has a small length cylindrical shape representing a circular top ridge having an intermediate diameter D3.

When the cannon wheel 2 is slipped onto the arbor portion 1*a* of the center wheel 1, the following phenomenon can be observed.

Now assuming that the inwardly projecting distance at 2*b* be expressed by $\alpha o$, the double-tapered portion 1*b*-1*e*-1*h* will engage at first with the inward projection 2*b* off from the inside wall surface 2*d* of the tubular arbor 2*a* of cannon pinion by such distance:

$$\alpha o - \frac{D1 - D3}{2}$$

whereby the tubular arbor is subjected to a corresponding amount of lateral resilient deflection. By utilizing the resilient structure at 2*a* in this way, the slip-on pressure for the assembly of the both parts 1 and 2 can be substantially reduced than otherwise. In addition, the cannon wheel 2 can be relieved from otherwise possible excess distortion during the assembling operation, yet assuring a sufficient friction torque necessary for the cannon wheel upon assembled thereof in position.

Figure 3:
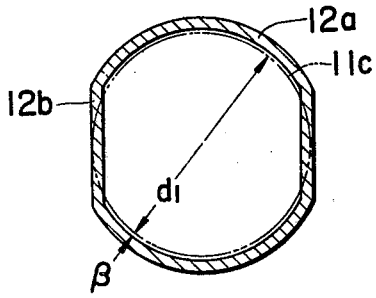
Figure 4:
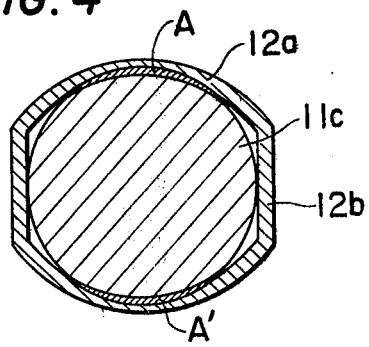

In this respect, a comparative analysis will be made with reference to FIGS. 3 and 4, illustrative of a conventional comparative arrangement in its cross section.

In FIG. 3, numeral 11*c* represents the cylindrical tip end of the arbor portion shown only schematically in chain-dotted lines, of a center wheel, and substantially corresponding to the foregoing portion 1*c* shown in FIG. 2, while numeral 12*a* represents the tubular portion of the cannon wheel. These related two portions represent a small fitting gap $\beta$ as shown. Numeral 12*b* represents an inwardly squeezed portion similar to that shown at 2. The arbor portion 11*c* has a diameter D1 at its root portion, with said diameter D1 being equal to the diameter D3 when measured at the tip end thereof.

In practice, however, the size of the gap formed between the inside diameter measured at the projecting portion of a traditional cannon pinion and the outer diameter at the end portion (having the same direction at the root portion) of the center wheel, appreciably fluctuates among a large number of mass-produced watch movements on account of fabrication dimensional errors. In addition, the height $\alpha 1$ at the projection 12*b* may be variable. A result of this may become highly disadvantageous when the tip end of the tubular portion 12*a* is brought into pressure engagement with the end portion 11*c*, as shown in FIG. 4, as the cross sectional area at 11c may occasionally be larger than the cross section of the space defined by the projections as at 12*b*, whereby the cannon pinion 12 is subjected to excess deformation as shown by dense hatched areas A and A′ in FIG. 4. This may result in the aforementioned drawback.

Figure 5:
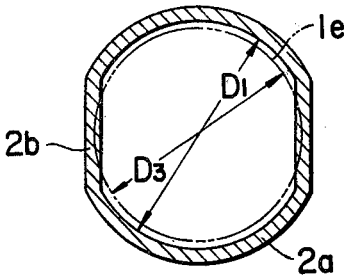
FIGS. 5 and 6 are views similar to FIGS. 3 and 4, for the illustration of the merits of the first embodiment of the invention.
Figure 6:
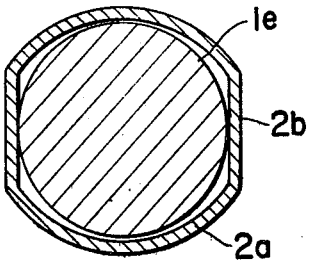

In the case of the first embodiment, as may be more clearly understood from FIG. 5, the diametral difference D1 – D3 has been set beforehand and thus is not influenced by fabrication errors. It may be further understood that the entrance diameter corresponding to D1 through which the maximum diameter portion D3 must pass during the assembly job, thus provides an ample idle gap for easy execution thereof. In addition, the middle portion 2*a* of the tubular portion of cannon wheel has enough resiliency as above mentioned, thus otherwise encountered rub-off of the material at the projection or projections at 2*b* during the assembly job is prevented. The elastic deformation of the tubular portion of the cannon wheel can be set within a reasonable range.

Figure 7:
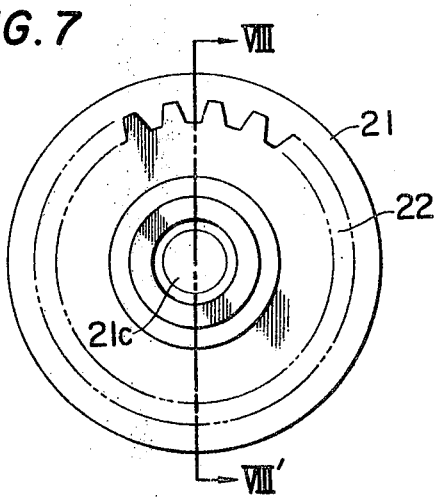
FIG. 7 is a view similar to FIG. 1, illustrative of a second embodiment of the invention.
Figure 8:
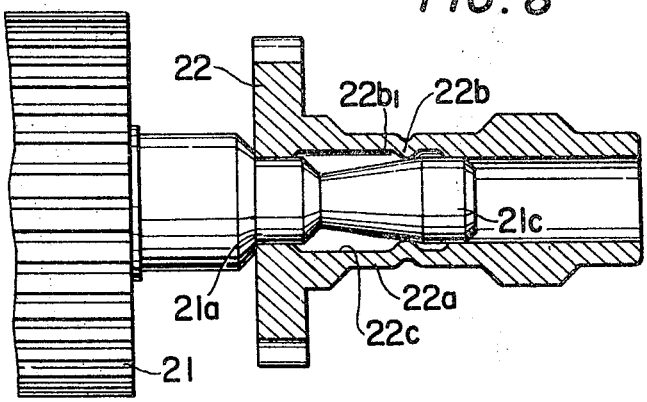
FIG. 8 is a view similar to FIG. 2, illustrative of the second embodiment, with the section being taken substantially along a section line VIII—VIII′ shown in FIG. 7.

Next, referring to FIGS. 7 and 8, illustrative of the second embodiment, numeral 22 represents a cannon wheel or pinion having an integral tubular portion 22*a* provided with a circumpherential recess 22*c* fabricated from inside and having an appreciable axial length. The tubular portion 22*a* has a thin wall thickness, so as to provide enough resiliency as above stated.

The inner end of the recess 22*c* is defined by the provision of one or more inwardly projecting circumferential projections 22*b* which may be, when necessary, fabricated into a continuous circular groove. The inwardly projecting distance at 22*b* is larger than the depth of the recess at 22*c*.

During a assembly job, by insertion of the stepped arbor portion 21*a* of a center wheel 21 into the bore of a cannon wheel 22, a tip end portion 21*c* of the arbor does not engage with the root 22*b*′ of the projection or projections 22*b*, but is brought into engagement with the projection(s) at a predetermined distance which can be expressed by $\alpha$ 2, for resiliently deforming the tubular portion. In this way, the axial force exerted during the assembly job can be kept within a reasonable range and excess elastic deformation thereof can be effectively prevented in a similar manner.

Figure 9:
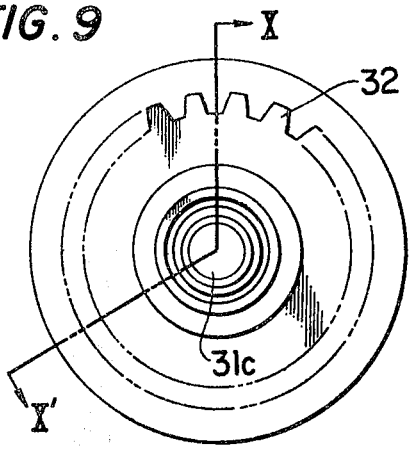
FIG. 9 is a view similar to FIG. 1, illustrative of a third embodiment of the invention.
Figure 10:
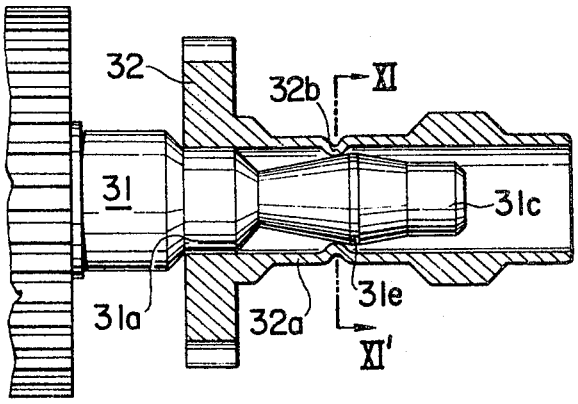
FIG. 10 is a view similar to FIG. 2, illustrative of the third embodiment, with the section being taken substantially along a section line X—X′ shown in FIG. 9
Figure 11:
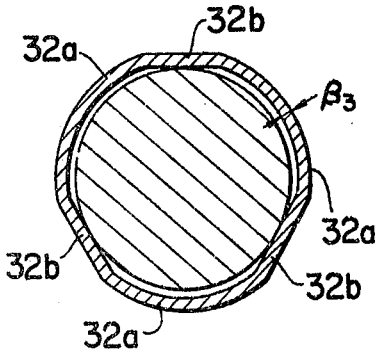
FIG. 11 is a cross section taken along a section line XI—XI′ shown in FIG. 10.

Finally, referring to FIGS. 9 – 11, the third embodiment of the invention will be explained briefly.

In this embodiment, numeral 32 represents a cannon wheel or pinion having a tubular portion 32*a* which has a generally thin wall thickness as a whole, so as to provide enough resiliency, representing practically a stepless bore configuration.

A circumferential ridge 31*e* is formed in a similar way to the portion 1*e* in FIG. 2. One or more of inwardly extending projections 32*b* are formed on an arbor portion 31*a* of a center wheel 31 at a small distance from the ridge 31*e* measured towards the gear portion of the center wheel 31, when seen in the assembled position shown.

The inwardly projecting distance which may be denoted with $\alpha$ 3, has been selected to be larger than R1 – R2 if R1 stands for the radius at the entrance portion of the cannon pinion bore and R2 stands for the radius at 31*e*.

It may well be understood from the foregoing that during the assembly job, the arbor end portion 31*c* does not contact with the root of the projection 32*b* and the engagement is carried out at such position as remote by the distance $\alpha$ 3 from the inside bore wall of the tubular portion of the cannon wheel. Therefore, again in the present embodiment, excess axial force may not be applied and excess resilient deformation of the tubular section can be avoided.

The embodiments of the invention in which an exclusive property or privelege is claimed are as follows:

1. A timepiece provided with a slip arrangement, comprising an arbor formed with a tapered portion, a pinion, a tubular portion having an elastic bore portion and integral with the pinion and at least an inwardly projecting projection on said tubular portion, said arbor being inserted into said tubular portion, said tapered portion and said projection being in resilient engagement with each other, so that said arbor and said tubular portion are thereby maintained in frictionally rotatable relationship with each other, the elastic bore portion of said tubular portion having a diameter larger than the largest diameter measured at a forward part of the arbor from said tapered portion, said inward projection being positioned within the area of said elastic bore portion.

2. The timepiece as claimed in claim 1 in which said tapered portion is defined by a double-tapered portion.

* * * * *